United States Patent [19]

Miles

[11] Patent Number: 4,575,080

[45] Date of Patent: Mar. 11, 1986

[54] AIR SUSPENSION BATTING TEE APPARATUS

[76] Inventor: Michael E. Miles, 2931 Arrowhead Bend, Willis, Tex. 77378

[21] Appl. No.: 604,166

[22] Filed: Apr. 26, 1984

[51] Int. Cl.[4] ..... A63B 69/40

[52] U.S. Cl. ..... 273/26 R; 273/29 A

[58] Field of Search ..... 273/29 A, 26 R, 359, 273/412, 369, 339, 372; 40/412, 439

[56] References Cited

U.S. PATENT DOCUMENTS

| | | | |
|---|---|---|---|
| 3,115,343 | 12/1963 | Lemelson | 273/359 |
| 3,869,123 | 3/1975 | McDaniel et al. | 273/359 |
| 4,345,765 | 8/1982 | Wang | 273/369 |

FOREIGN PATENT DOCUMENTS

| | | | |
|---|---|---|---|
| 839464 | 5/1952 | Fed. Rep. of Germany | 273/399 |
| 2258353 | 2/1974 | Fed. Rep. of Germany | 273/399 |
| 813051 | 5/1937 | France | 273/399 |

*Primary Examiner*—Richard C. Pinkham
*Assistant Examiner*—T. Brown
*Attorney, Agent, or Firm*—Kolisch, Hartwell & Dickinson

[57] ABSTRACT

An air suspension batting tee apparatus which includes an air blower for providing a moving air column which supports a spherical object, a conduit terminating at a nozzle for directing the air column, and an oscillator for producing a fluctuation in the flow of the air column through the nozzle. A ball suspended in the air column may be made to oscillate vertically. An air flow displacement arm may be used to produce oscillating movement of a suspended object in a cylindrical path around a vertical axis, thereby simulating motion of a curve ball or a screw ball. The nozzle may be adjusted to varying heights to place a suspended ball within a strike zone for varying sized batters.

5 Claims, 6 Drawing Figures

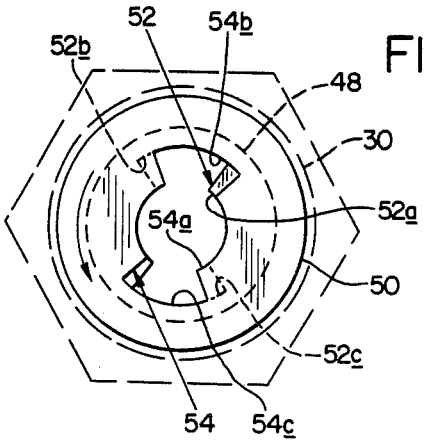
FIG. 3
FIG. 4
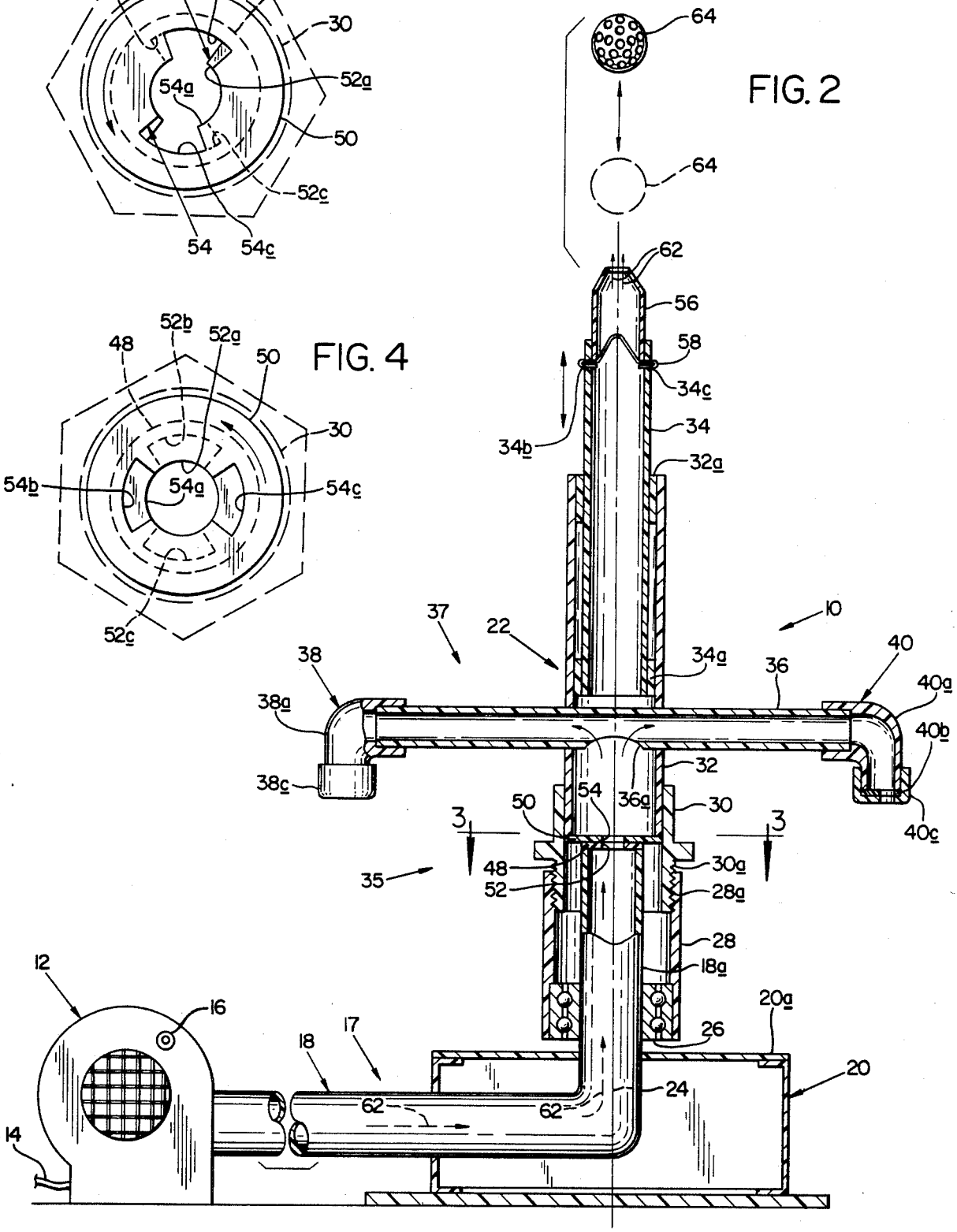
FIG. 2

AIR SUSPENSION BATTING TEE APPARATUS

BACKGROUND AND SUMMARY OF THE INVENTION

The present invention relates to apparatus for supporting a ball such that the ball simulates the motion of a pitched ball prior to being struck by a bat. Specifically, the instant invention is an air suspension batting tee apparatus which supports a ball on a column of air, allowing the ball to move, in an oscillatory fashion, up and down, thereby simulating the action of a pitched ball.

A variety of batting tees are known. The most common form of batting tee comprises a solid support which is mounted vertically on a base, and which supports a ball on the upper end of the column. Such a device in effect, provides a stationary target for a batter. Such a column may be adjustable in height. The column may be flexibly mounted, by allowing it to flex should it be struck by a miss-aimed bat.

Devices are also known which support a ball on a column of air and which project the ball in the general direction of a batter.

The known devices do not, however, provide for simulation of ball motion as the ball drops or rises, or follows a curved path, as it approaches the batter.

An object of the instant invention is to provide an air suspension batting tee apparatus which will improve the eye/hand coordination of the batter and condition the batter to keep his/her eye on the ball while in the process of attempting to hit the ball.

Another object of the instant invention is to provide an apparatus which will simulate the rising, falling and curving motion of a ball as it approaches a strike zone.

A further object of the instant invention is to provide a batting tee apparatus which is adjustable in height, thereby accommodating various heights of strike zones in differently sized batters.

Yet another object of the invention is to provide such a batting tee which is capable of with standing impact by a swung bat.

The apparatus of the instant invention includes a base which is suitably attached to a motor-driven blower. The blower provides a moving column of air which exists an upper portion of the apparatus through a nozzle to support a ball. Two types of air directors may be used. The first type of air director is a straight, flow-through nozzle which serves to restrict and direct an air stream. The second type of air director is an air flow displacement arm which may replace the nozzle. Means are provided for producing fluctuation in the intensity of the air stream, thereby causing a ball supported on the air column to rise and fall. When the flow-through nozzle is used, a ball is supported directly above the apparatus for oscillation above the nozzle.

The displacement arm has an outlet laterally displaced from the nozzle location. A ball suspended above the displacement arm outlet revolves about an axis of rotation while oscillating vertically. This simulates the motion of a screw ball or curve ball. The height of the nozzle is adjustable vertically to accommodate batters of different heights. The nozzle and air displacement arm are constructed to withstand impact by a swung bat.

These and other objects and advantages of the invention will become more fully apparent as the description which follows is read in conjunction with the drawings.

DESCRIPTION OF THE DRAWINGS

FIG. 2 is a median sectional view through the apparatus of FIG. 1 with a flow-through nozzle mounted thereon.

FIG. 3 is an enlarged top plan view of a portion of an oscillator of the apparatus taken generally along the line 3—3 in FIG. 2.

FIG. 4 is a view similar to FIG. 3, showing a plate of the oscillator rotated from the position shown in FIG. 3.

DETAILED DESCRIPTION OF A PREFERRED EMBODIMENT

Figure 5:
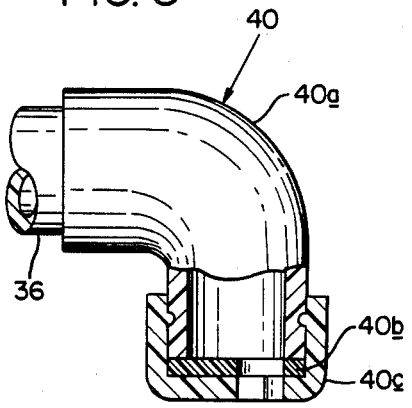
FIG. 5 is an enlarged partial cross-section view of an adjustable air jet, taken generally along the line 5—5 in FIG. 2.
Figure 6:
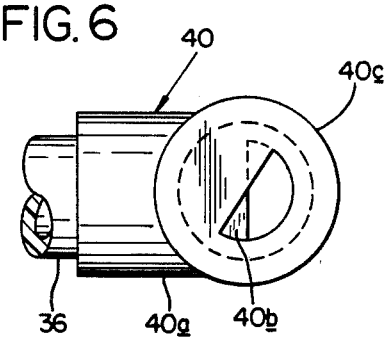
FIG. 6 is an enlarged view of an adjustable air jet taken generally along the line 6—6 in FIG. 2.
Figure 1:
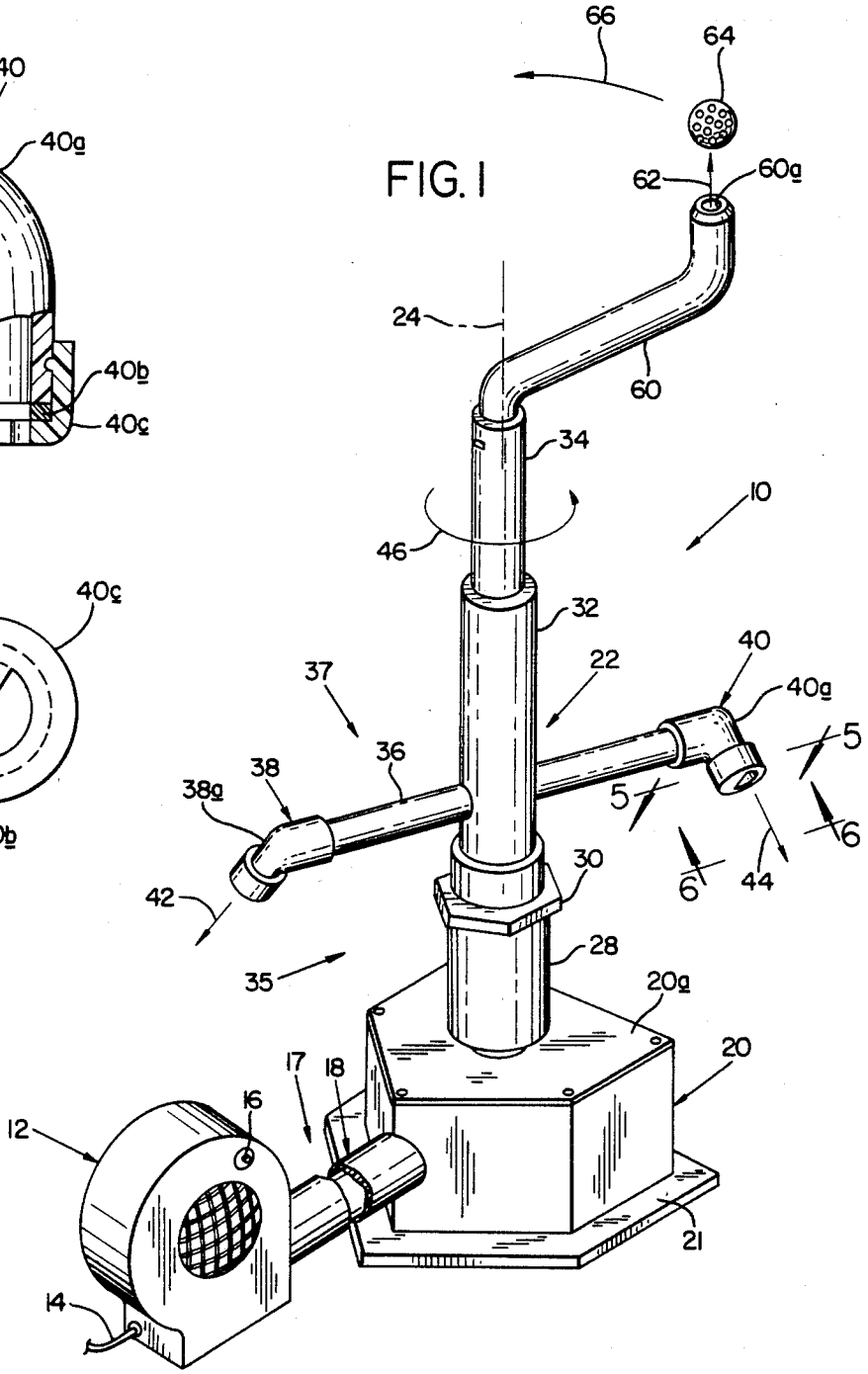
FIG. 1 is a perspective of an air suspension batting tee apparatus constructed according to the instant invention with an air flow displacement arm mounted thereon.

Turning now to the drawings, and initially to FIGS. 1 and 2, an air improvement batting tee apparatus is shown generally at 10. The apparatus includes air pressurization means, which in the preferred embodiment, takes the form of a motor-driven blower 12. Blower 12 in the preferred embodiment is a Model 600 impeller-type blower manufactured by Green Machine Company. The blower is powered by a 0.35 horsepower motor, turning at 8,000 rpm, producing a moving air stream with a volume of approximately 210 cu. ft. per minute. Blower 12 is connected to a suitable 110 volt AC power supply by a cord 14. A variable speed off/on switch 16 turns the motor on and off, thereby controlling the blower and the speed of the air stream produced thereby. Blower 12 is detachably connected to conduit means, shown at 17, including an air conduit 18 which enters a side of a box-like batting tee base 20 and subsequently makes a right angle bend, exiting through the center of a removable base top 20*a*. Conduit means 17 may be thought of as defining the travel path of an air column produced by blower 12. Base 20 is depicted, in FIG. 1, positioned on a ball diamond home plate 21.

An air column enclosure, shown generally at 22, is mounted above the base substantially coaxially on a base segment or portion 18*a* of air conduit 18 which projects vertically through the top of the base. Column enclosure 22 and portion 18*a* are disposed about a central vertical axis 24.

Enclosure 22 further includes a number of conduit segments, now to be described, which are assembled to provide a working mechanism for the apparatus.

Referring now to FIG. 2, an air-sealing bearing 26 is mounted on conduit portion 18*a* adjacent base 20. A first segment 28 of enclosure 22 is mounted on bearing 26 and is thus rotatable about axis 24 relative conduit 18 and base 20. Segment 28 has internal threads 28*a* located adjacent its upper inner margin. Threads 28*a* receive a second segment 30 which has threads 30*a* which are conformal with threads 28*a* thus allowing segment 30 to be removably affixed to segment 28 and rotatable therewith.

A third segment 32 is press-fitted into the upper portion of segment 30.

A fourth segment 34 of enclosure 22 is telescopically mounted in segment 32 and is thus positionable to a known variable height above base 20. Enclosure 22 forms what is referred to as a conduit end segment. Segment 34 is thus operatively connected to the air pressurization means and directs the moving air column produced by the air pressurization means. The telescoping feature of the fourth segment provides a means for adjusting the height of the top or exit end of segment 34 about base 20. Stops 32*a* and 34*a*, mounted on the top inside surface of segment 32 amd on the outside surface of the lower end of segment 34, respectively, as shown, prevent separation of segment 32 and the fourth segment.

The apparatus includes an oscillator, also referred to as fluctuation means and oscillation means, shown generally at 35, which, is a preferred embodiment, is operatively interposed the air blower and the fourth conduit segment and produces an oscillation in the air column, issuing from the top or exit end of segment 34. The oscillator causes an object, such as a ball, when placed in the exiting air column to be suspended or supported by the moving air column and, further, to alternately rise and fall.

Oscillator 35 includes an air power rotation driver or drive means, shown at 37, which rotates enclosure 22 about axis 24, also referred to as an exit-end axis of rotation. Driver 37 ultimately sets an interval for the rise and fall of an object supported by the air column. Driver 37 includes an air diverter or diverter means 36 which is fixedly mounted in segment 32. Air diverter 36 in the preferred embodiment is a hollow tube which has a segment cut from its lower or upstream side intermediate its ends within segment 32 and provides an air diversion opening or inlet 36*a*. A pair of air jets, or jet means, 38, 40 are rotatably attached to each end of diverter 36. The air jets include elbow portions 38*a*, 40*a* which turn air moving from the diverter 90°. By moving the air jets to the position as shown in FIG. 1, an air stream, represented by arrows 42 and 44, exits the jets, thereby causing enclosure 22, and therefore segment 34 to rotate counterclockwise about axis 24 in the direction shown by arrow 46. Accordingly, axis 24 is also referred to as a jet axis of rotation. Thus the oscillator is powered by the air column and diverter 36 serves to divert a portion of the air column to jets.

The jets terminate in end plates 38*b*, 40*b*, each secured at an end of the corresponding elbow. End plates 38*b* and 40*b* each have a half-circular cutout to allow air to escape therethrough. The jets further include end caps 38*c*, 40*c* which are rotatably received on the end of their respective elbow portions. The caps also include half-circular cutouts which conform to those of the end plates. The end caps may be rotated to open or occlude the openings at the ends of the jets, thereby providing a means for varying the air flow exiting from the jets.

Oscillator 35 also includes a pair of disks or plates with key-hole-like passages which alternately align and misalign to partially interrupt the air supply to the air column. In the preferred embodiment, the base or first plate 48 is fixed to the upper margin, or downstream end, of conduit portion 18*a*. A second, or rotating plate 50 is rotatably mounted proximal first plate 48. The plates of the column pulsing means, in the preferred embodiment, are disk-shaped plates and are mounted normal to the moving air column. Plates 48 and 50 are also referred to as air flow constriction means, or more simply, as constrictors. Second plate 50 is removably press fitted in segment 30 adjacent the base or lower end of segment 32.

Turning now to FIGS. 3 and 4, top plan views of plates 48 and 50, in substantially aligned and misaligned positions, respectively, are shown. Referring to FIG. 3, plates 48 and 50 each include a passage, shown generally at 52 and 54, respectively. Each passage includes a central circular portion 52*a*, 54*a*, respectively, and a pair of wing-shaped portions 52*b*, 52*c* and 54*b*, 54*c*, respectively, which are contiguous with the central circular portions of the passages. As shown in FIGS. 2 and 3, the passages, which are conformal with each other, are nearly in an aligned position, thereby providing near maximum air flow through the apparatus.

Turning now to FIG. 4, plates 48 and 50 are shown with plate 50 having been rotated approximately 90° and the wing-shaped portions being completely misaligned. Thus, the air column is restricted to moving through the centrral passages 52*a*, 54*a*. Since plate 50 and enclosure 22 rotate unitarily as they are driven by driver 37, which includes the air jets, second plate 50 is therefore operably connected to the air jets and driven thereby.

An object may be supported on the air column produced by the apparatus directly above the apparatus, in line with axis 24, or a ball may be supported at a position laterally displaced from axis 24. To this latter end, two additional components are provided.

Referring first to FIG. 2, a nozzle 56 is received atop the rotatable exit end of segment 34 and rotates therewith. Nozzle 56 is retained in place by a spring 58 which is in turn retained in a pair of bores 34*b*, 34*c* in the throat of segment 34.

Turning now to FIG. 1, the nozzle may be removed and an air flow displacement arm 60, also referred to as an exit end extension member, may be installed on the fourth segment in its place. Displacement arm 60 includes an outlet 60*a* which, as segment 34 rotates, revolves about axis 24. Outlet 60*a*, also referred to as a revolving exit end, is spaced from axis 24 and causes the air column to be laterally displaced from the axis and air column enclosure 22.

When blower 12 is activated, a moving column of air, represented by arrows 62, moves along a travel path through conduit means 17, including through conduit 18 and the interior of enclosure 22, and exits the apparatus through nozzle 56 or displacement arm 60. If a spherical object, such as ball 64, is placed in the exiting moving air column, the ball will be lifted above the level of end segment 34 and will remain aloft so long as the air column continues to move. Essentially, the air column provides aerodynamic lift at the upper portion of ball 64, thereby keeping it aloft. The ball remains at a given height supported by a given volume of air moving at a given speed when the amount of lift created by the air column equals the weight of the ball.

The ball may be made to oscillate up and down as shown in phantom lines in FIG. 2, by changing the volume of air in the column. When jets 38 and 40 are positioned at an angle relative to axis 24 to direct air streams flowing therethrough in opposing directions, as shown in FIG. 1, enclosure 22 will begin rotating in the direction indicated by arrow 46. As enclosure 22 is driven by the torque produced by the air jets, second plate 50 will rotate relative first plate 48, alternately diminishing and restoring air flow through the upper portion of enclosure 22. Assuming that nozzle 56 is attached atop segment 34 and the jets are positioned as shown in FIG. 1, ball 64, during operation, oscillates up and down along axis 24. This simulates the movement of a pitch approaching a batter which is either dropping or rising as it passes through the batter's strike zone. The telescoping aspect of segments 32 and 34 allows the height of a strike zone to be adjusted for different sized batters.

The air jets are rotatable through a full 360°, and end caps 38*c* and 40*c* are adjustable to allow varying amounts of air to pass through the jets. Thus, a full range of rotational speeds may be set, thereby allowing the interval of rising and falling of the ball to be completely adjustable.

Referring to FIG. 1, the air flow displacement arm 60 is attached to segment 34. As the fourth segment rotates, outlet 60*a* revolves about axis 24, in the direction of arrow 66. Ball 64 is entrained in the moving air column and revolves about axis 24 with the displaced air column. A batter standing adjacent the apparatus will be trained to swing at a ball which is both oscillating in the vertical and which is also following a curved path, thereby simulating the action of a curve ball or a screw ball.

The oscillator may be disabled by removing second plate 50 from segment 30, thereby allowing for a constant flow of air through enclosure 22. This feature is desirable in conjunction with use of displacement arm 60 when it is desired to train the batter to swing at a ball which is curving towards or away from the batter, but which is not oscillating in the vertical.

As one might suspect, a batter may occasionally make a low swing, thereby impacting the apparatus with a bat. For this reason nozzle 56 and air flow displacement arm 60 are mounted on segment 34 such that they are capable of withstanding impact by a swung bat. Specifically, nozzle 56 and displacement arm 60 are releasably retained by spring 58 and will detach from the remaining parts of the apparatus should they be struck. This type of flexible mounting allows for impact without significant damage. Should either nozzle 56 or displacement arm 60 be damaged as a result of impact, these pieces are relatively inexpensive and may be easily replaced. Likewise, should the impact be at a point below the level of attachment of nozzle 56 or arm 60, the upper portions of enclosure 22 are the less expensive components of the apparatus and also may be replaced at small cost.

In a typical embodiment, the apparatus is constructed from readily available PVC or ABS plastic which is easily formed and cut to desired shapes. These materials also have the ability to withstand substantial impact without shattering.

The apparatus may also be adapted, through inclusion of different blowers, nozzles or displacement arms, to support a variety of ball types as would be used, for example, in tennis, racket ball, ping pong, etc.

While a preferred embodiment of the invention has been described, it will be appreciated that variations and modifications may be made without departing from the spirit of the invention.

It is claimed and desired to be secured by Letters Patent:

1. An air suspension batting tee apparatus for fluctuatingly supporting a spherical object on a moving air stream, comprising conduit means having an exit end for transmitting an air stream along a travel path therethrough and for controlling the issuance of the air stream from the exit end in a manner capable of producing suspension of a spherical object in the issuing air stream, air pressurization means operatively joined to said conduit means for providing such an air stream in the conduit means, and fluctuation means operatively connected to said conduit means for producing fluctuations in the air stream issuing from the exit end of said conduit means, said fluctuation means including air-flow constriction means disposed in the air stream travel path in said conduit means which is adjustable cyclically to vary the transverse area of the travel path adjacent said constriction means, said constriction means including a pair of relatively rotatable air-flow constrictors having air-flow accommodating passages which cooperate during relative rotation to provide a travel path for at least a part of the air stream, the transverse area of which varies according to the relative position of said constrictors, said constrictors being adjacent and the passages in the adjacent constrictors being disposed to align substantially by varying amounts during relative rotation when viewed along the air stream travel path, one of said constrictors being fixed relative to said conduit means, said fluctuation means further including air-flow-driven rotation drive means operatively drivingly connected to the other of said constrictors for rotating the same.

2. The apparatus of claim 1, wherein said drive means includes air diverter means for diverting a portion of the air stream traveling through said conduit means and air jet means joined to said diverter means for operably receiving diverted air from the diverter means, said diverter means and jet means being operatively fixedly joined to the other of said constrictors and constructed to rotate as a unit therewith during operation.

3. The apparatus of claim 2, wherein said jet means is rotatable about a jet axis of rotation and directs the issuance of air therefrom in a direction producing rotation of said jet means about the jet axis, the jet means being adjustable for varying the rotation-producing torque produced by said jet means.

4. The apparatus of claim 2, wherein said drive means includes means for adjusting the amount of air exiting from said jet means.

5. An air suspension batting tee apparatus for fluctuatingly supporting a spherical object on a moving air column comprising conduit means having a vertically disposed end segment having a rotating exit end and an upstream lower end disposed vertically below the rotating exit end, said end segment further being rotatable and generally symmetrically disposed about a vertical exit end axis of rotation, said conduit means also having a generally fixed base segment having a downstream end joined air sealingly and rotatably with the lower end of said end segment, said conduit means being for transmitting an air column along a travel path in a known direction therethrough and for controlling the issuance of the air column from the exit end in a manner capable of producing suspension of a spherical object in the issuing air column, air-pressurization means operatively joined to said conduit means for providing such a moving air column in the conduit means, and air column oscillation means including a fixed base disk disposed on the downstream end of said base segment and a rotating disk disposed on the lower end of said end segment adjacent said base disk, said disks being relatively rotatable and having air-flow-accommodating passages which cooperate, during rotation, to vary the effective transverse area of the air column passing through said disks, said oscillation means further including rotation drive means having an air-diverting tube extending through the air column travel path in and fixedly mounted on said conduit end segment, said tube extending radially from said end segment normal to the exit end axis of rotation and having an opening disposed within said end segment extending partially circumferentially about said tube opening toward the lower end of said end segment, said drive means further having air jets disposed at opposite ends of said tube directed to produce, coopertively, rotation of said end segment about the exit end axis of rot

* * * * *